United States Patent [19]

Prinsloo et al.

[11] Patent Number: 4,674,628

[45] Date of Patent: Jun. 23, 1987

[54] CARD HOLDING DEVICE

[75] Inventors: Paul M. Prinsloo; Theunis J. Botha; Jacobus C. J. van Schalkwyk, all of Pretoria; Nimrod J. J. Smit, Wonderboom, all of South Africa

[73] Assignee: Card Carriers (Manufacturing) (Proprietary) Limited, Transvaal Province, South Africa

[21] Appl. No.: 731,569

[22] Filed: May 7, 1985

[30] Foreign Application Priority Data

May 7, 1984 [ZA] South Africa ..... 84/3387
May 7, 1984 [ZA] South Africa ..... 84/3389

[51] Int. Cl.[4] ..... A45C 11/18; G08B 3/10

[52] U.S. Cl. ..... 206/38.1; 40/17; 40/330; 116/2; 116/DIG. 1; 116/DIG. 44; 206/38; 206/39

[58] Field of Search ..... 40/2 A, 2 R, 10 R, 16, 40/17, 330; 116/2, 67 R, 80, 99, 307, 321-324, DIG. 1, DIG. 44; 206/37.1, 38.1, 39, 425, 449, 454, 455, 555, 39.5, 459, 38; 220/22

[56] References Cited

U.S. PATENT DOCUMENTS

| | | | |
|---|---|---|---|
| 1,066,129 | 7/1913 | Manasse | 206/39 |
| 1,822,843 | 9/1931 | Clarke et al. | 206/39 |
| 2,468,817 | 5/1949 | Duchin | 206/39 |
| 2,928,195 | 3/1960 | Fischer | 40/17 |
| 3,200,983 | 8/1965 | Walter | 220/40 |
| 3,306,326 | 2/1967 | Thomas | 206/39 |
| 3,424,122 | 1/1969 | De Angelis | 116/2 |
| 3,452,463 | 7/1969 | Chaput | 40/17 |
| 3,659,365 | 5/1972 | Eaton | 40/16 |
| 4,223,804 | 9/1980 | Morris et al. | 116/DIG. 44 |
| 4,339,061 | 7/1982 | Dunn | 116/DIG. 44 |
| 4,358,012 | 11/1982 | Marsala et al. | 206/39 |
| 4,449,474 | 5/1984 | Mariol | 116/DIG. 44 |
| 4,518,080 | 5/1985 | Ohlson | 206/39 |

FOREIGN PATENT DOCUMENTS

| | | | |
|---|---|---|---|
| 0871609 | 6/1961 | United Kingdom | 206/449 |

*Primary Examiner*—William Price
*Assistant Examiner*—Jimmy G. Foster
*Attorney, Agent, or Firm*—Ladas & Parry

[57] ABSTRACT

A portable pocket-size card holding device includes a holder capable of holding a plurality of cards. The holder comprises a pair of spaced floor and top members, laterally spaced side members extending between the floor and top members, and an end member extending between a first set of ends of the floor, top and side members so that the one end of the holder is closed off and its other end is open, with the members defining between them a cavity. Spaced channels are provided along the top and floor members. The channels are located inside the cavity and extend substantially parallel to one another, with the channels of the top member being aligned with those of the bottom members so that, in use, cards in the holder will extend substantially parallel to the side members. Each pair of channels in the top and floor members provides a card receiving zone capable of accommodating a single card. All the cards are insertable into and removable from the cavity in the same direction through the open end of the holder. The device also includes a card retention arrangement for retaining the cards in position in the holder. The retention arrangement comprises a pair of protrusions protruding respectively form one of the side portions towards the other side portion of each channel, and spaced with clearance from the other side portion. The pair of protrusions of each channel are aligned with each other.

10 Claims, 8 Drawing Figures

CARD HOLDING DEVICE

This invention relates to a card holding device.

SUMMARY OF THE INVENTION

The Applicant is away that cards such as credit cards, visiting cards, identification cards, and the like, are being used increasingly in modern-day society. The Applicant is further aware that such cards are usually stored relatively inaccessibly, eg in a pocket of a user's clothing, in a wallet, etc, making it difficult to remove the cards rapidly and easily. Furthermore, a user is prone to forgetting such cards, eg forgetting them at his place of residence, or misplacing them, which is inconvenient and can be embarrassing.

It is accordingly an object of this invention to provide a card holding device whereby these drawbacks are at least reduced.

According to a first aspect of the invention, there is provided a portable card holding device which includes a holder capable of holding a plurality of cards;

locating means for locating the cards alongside one another in spaced relationship within the holder;

card retention means for retaining the cards in position in the holder; and a key ring attached to the holder.

The card may comprise a planar member having a rigid backing sheet to which is applied indicia such as letters, numerals, identification means, or the like. Typically, the backing sheet may be of plastics material, and the indicia may be embossed thereon. In particular, the card may be a card in accordance with ISO or other standards, for instance having dimensions of about 85 mm × 54 mm × 1,0–1,2 mm. Such a card may be a credit card, visiting card, driver's licence, or the like identification card, access control card, debit card, passport, or other card-shaped item, such as a calculator. Hence, by 'card' in this specification is meant a credit card, visiting card, driver's licence card, or the like identification card, access control card, debit card, passport, or other card-shaped item, such as a calculator.

The holder may be of rectangular box-like construction and may comprise a pair of spaced floor and top members, laterally spaced side members and longitudinally spaced end members which are interconnected to define between them a cavity.

In one embodiment, the locating means may comprise recesses in at least one of the members, each recess providing a card receiving zone capable of accommodating a single card within the cavity.

The recesses may be provided by spaced channels extending substantially parallel to one another along at least the top and floor members, or along at least the end members, so that, in use, the cards will extend substantially parallel to the side members.

At least one of the side members may be provided with a window so that cards inside the cavity are visible from the outside.

In one embodiment of the invention, one of the end members may be provided with access slots aligned with the channels, for inserting the cards into the holder. In another embodiment of the invention, the top member may comprise a cover hingedly attached to at least one of the other members so that, on opening the cover, cards can be inserted into, or removed from, the holder.

Each channel may comprise a base portion and spaced side portions protruding from the base portion and extending along the base portion. The retention means may comprise at least one protrusion protruding from each of the side portions towards the other side portion, and spaced with clearance from the other side portion, ie terminating short of the other side portion.

The pair of protrusions of each channel may be aligned with each other, and may be arcuate-shaped when the channel is seen in plan view.

In another embodiment of the invention, the device may include a plurality of pockets within the cavity, each pocket providing a card receiving zone capable of accommodating at least one card.

The device may include warning means for emitting a warning signal on removal of a card from the holder. The warning means may be electrically and/or electronically operable. The warning means may comprise a switch associated with one or more of the card receiving zones and adapted to be activated on removal of a card from the zone; a a visual and/or aural warning device; electric and/or electronic circuitry interconnecting the switch and the warning device; and a power source for the circuitry.

According to a second aspect of the invention, there is provided a portable card holding device which includes a holder capable of holding at least one card; and warning means for emitting a warning signal on removal of a card from the holder.

The device may include accessory holding means for holding an accessory attached to the holder. The accessory holding means may comprise a key ring. The key ring may be attached to the holder by means of a flexible elongate member, eg a chain.

According to a third aspect of the invention, there is provided a portable card holding device which includes a holder comprising a pair of spaced floor and top members, a pair of longitudinally spaced end members and a pair of laterally spaced side members defining between them a card receiving cavity or zone capable of accommodating at least one card;

card retention means comprising at least one protrusion protruding inwardly from at least one member of one of the pairs of members towards the other member of the pair, and spaced with clearance from the other member of the pair so that the card can be retained in position by being gripped between the protrusions; and accessory holding means for holding an accessory attached to the holder.

BRIEF DESCRIPTION OF THE DRAWINGS

The invention will now be described by way of example with reference to the accompanying diagrammatic drawings.

In the drawings.

DETAILED DESCRIPTION

Figure 1:
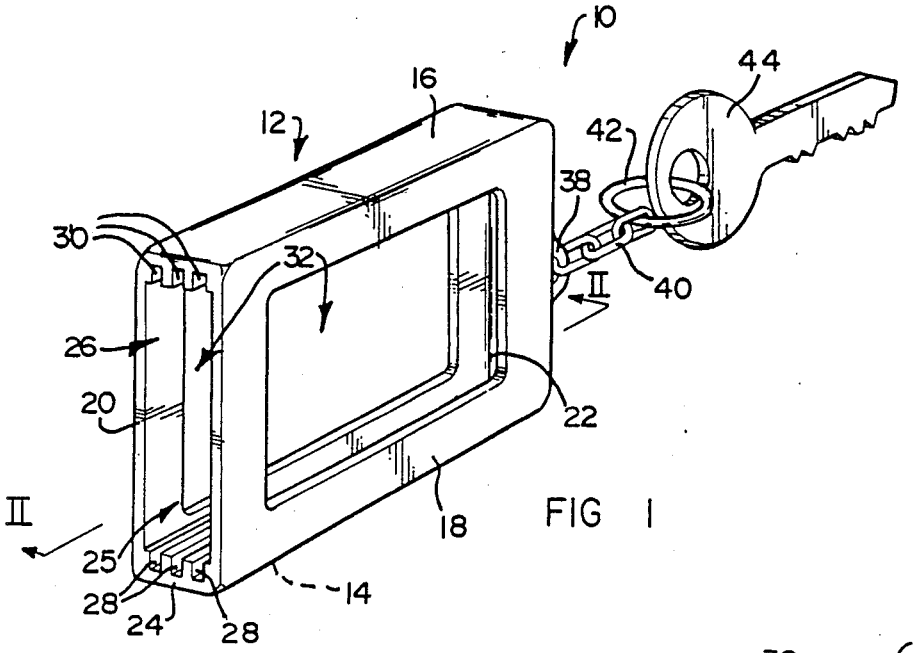
FIG. 1 shows a three-dimensional view of a portable card holding device according to one embodiment of the invention.
Figure 2:
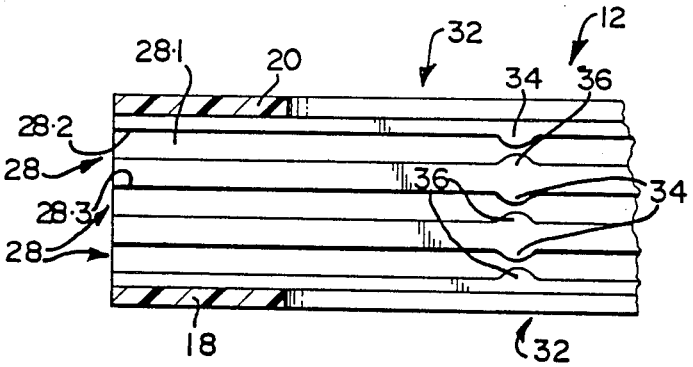
FIG. 2 shows, in part, a sectional view through II—II in FIG. 1.

Referring to FIGS. 1 and 2, reference numeral 10 generally indicates a portable card holding device according to one embodiment of the invention.

The device 10 includes a rectangular box-like holder, generally indicated by reference numeral 12. The holder 12 includes a floor member or panel 14 as well as a top member or panel 16 spaced apart from each other and extending substantially parallel to each other. It also includes laterally spaced rectangular-shaped side members or panels 18 and 20, between the members or panels 14, 16. It still further includes longitudinally spaced end members 22, 24 interconnecting the members 14, 16, 18 and 20. The members or panels 16 to 24 define between them a cavity 25.

The end member 24 is provided with an access opening 26 leading into the cavity or chamber 25.

Inside the cavity or zone 25, the member 14 is provided with three spaced channels 28 extending substantially parallel to each other and extending along substantially the entire length of the member 14. Likewise, inside the cavity 25, the member 16 is provided with three spaced channels 30 extending substantially parallel with each other and extending substantially along the whole length of the member 16. The channels 30 are aligned with the channels 28.

In other embodiments of the invention (not shown), a greater or lesser number of channels 28, 30 may be provided. Furthermore, in another embodiment (not shown), instead of a single access opening 26 being provided, an access slot for each of the pairs of channels 28, 30 may be provided in the end member 24.

In each of the side members or panels 18, 20 there is provided a window 32. In other embodiments of the invention (not shown), one or both of the windows can be dispensed with so that one or both of the sides 18, 20 is of substantially solid planar form, or the sizes of the windows can be varied, or combinations of differently sized windows and/or no windows in one or both of the side members 18, 20 can be provided. When one or both of the panels 18, 20 are of substantially solid planar form, they can then be rendered aesthetically pleasing by being coloured, having letters, numerals or pictures, such as advertising indicia, provided thereon, by providing a sleeve (not shown) around the holder 12. When the sleeve is provided, the sleeve may be of flexible material such as plastics material, animal skin (for example, buck hide, crocodile hide, or the like). Instead, it may be a substantially solid sleeve which may be of metal, plastics material, bone, ivory, or the like. In particular, it may be of metal such as aluminium, silver, copper, gold, etc., or combinations thereof.

Each of the channels 28 comprises a base portion 28.1 and a pair of spaced side portions 28.2, 28.3 protruding from the base portion and extending along the base portion. The device 10 also includes a pair of arcuate- or convex-shaped protrusions 34, 36, aligned with each other, protruding from the side portions 28.2 and 28.3 respectively of each channel. The protrusions 34, 36 are spaced with clearance from each other so that a card (not shown) can be inserted between them and gripped, ie retained in position, by them. Similar protrusions can be provided in the channels 30, if desired.

An eyelet 38 is attached to or integral with the member 22 of the holder 12, and a chain 40 is attached to the eyelet 38. A key ring 42 is attached to the free end of the chain 40, and a key 44 is attached to the key ring. In other embodiments (not shown), the eyelet 38 can be attached to any of the other members, if desired, for example the members 14 or 16.

In use, a card (not shown), which may be a credit card, driver's licence card, visiting card, or the like, identification card, or other card or card-shaped item as hereinbefore described, is inserted into one of the pairs of channels or grooves 28, 30. The dimensions of the card and holder 12 are such that the card fits snugly inside the grooves 28, 30. The card is gripped frictionally by the pair of protrusions or gripping members 34, 36. Hence, a plurality of cards can be accommodated in spaced relationship in the holder 12.

Preferably, the card may be of a standardized size, such as a card which complies approximately with ISO or other specifications, for instance having dimensions of about 85 mm×54 mm×1,0–1,2 mm, and being of plastics material. The inside of the holder may then typically have the following dimensions:

| | |
|---|---|
| thickness of the members 18,20,etc | 1–2 mm |
| width of the grooves 28,30 | 1 mm |
| distance between the base portions of a pair of grooves 28,30 | 54–55 mm, eg 54,5 mm. |

The holder 12 may be of plastics material, e.g. synthetic plastics material such as polypropylene, ABS, or the like.

Figure 3:
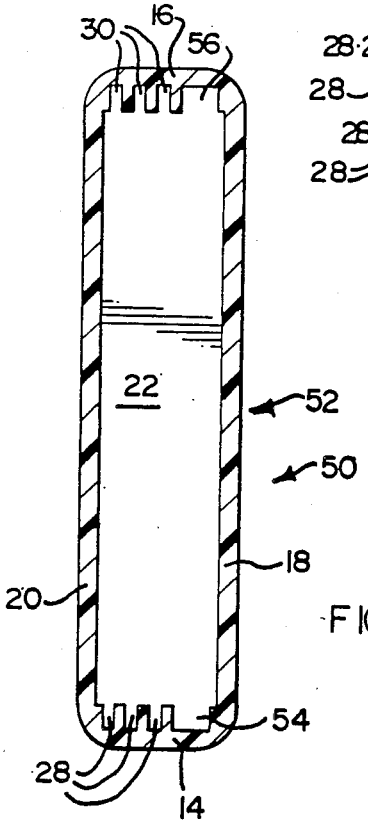
FIG. 3 shows a cross-sectional view of a portable card holding device according to another embodiment of the invention.

Referring to FIG. 3, reference numeral 50 generally indicates a portable card holding device according to another embodiment of the invention, with details omitted for clarity.

Parts of the device 50 which are similar to those of the device 10 hereinbefore described with reference to FIGS. 1 and 2, are indicated with the same reference numerals.

The device 50 includes a card holder, generally indicated by reference numeral 52. The card holder 52 comprises bottom and top members or panels 14 and 16 respectively, laterally spaced side members or panels 18 and 20, and an end member 22.

As was the case with the holder 12 hereinbefore described with reference to FIGS. 1 and 2, grooves 30,28 are provided in the members 16,14 respectively. Three pairs of grooves 28,30 are provided.

However, the member 14 also includes a fourth groove 54 in the member 14 and which is somewhat wider than the grooves 28. Likewise, the member 16 includes a wider groove 56 aligned with the groove 54.

In use, a plurality of cards, located in abutting relationship, can fit into the grooves 54,56.

Figure 4:
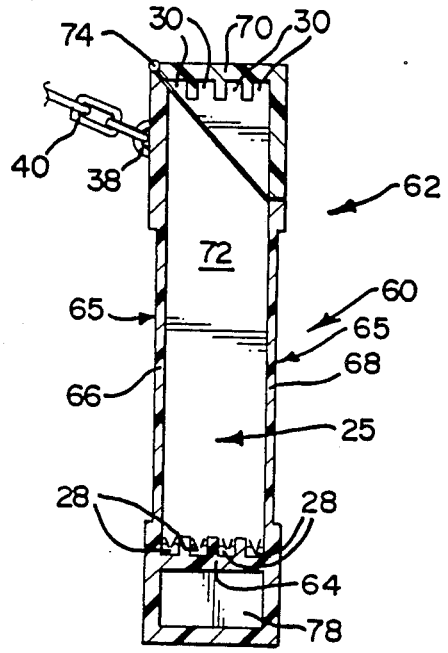
FIG. 4 shows a cross-sectional view similar to FIG. 3, of a portable card holding device according to yet another embodiment of the invention.

Referring to FIG. 4, reference numeral 60 generally indicates a portable card holding device according to yet another embodiment of the invention.

The device 60 includes a holder generally indicated by reference numeral 62.

The holder 62 includes a base or bottom panel or member 64, a pair of laterally spaced side members 66,68 protruding upwardly from the base member 64, and a top or cover member 70. It also includes a pair of spaced end members, only one of which, as indicated by reference numeral 72, is shown.

The cover member 70 is generally of inverted L-shape when seen in cross-section, and is hingedly attached to the upper edge of the member 66 by means of a hinge formation 74. The hinge formation 74 is such that the cover member 70 is normally biassed to its closed position as indicated in FIG. 4.

Recesses 28,30 are provided in the base or floor member 64 and the cover portion 70.

The device 60 also includes a pair of contacts 74, 76 protruding from the side portions of each of the channels 28. The contacts 74 are biassed towards each other, for example by means of springs (not shown) so that they will be in contact with each other when no card is located in that groove 28. On insertion of a card (not shown) into the groove 28, the contacts will be biassed apart.

Each pair of contacts 74,76 forms a switch 75 which forms part of an electronic/electrical circuit 80.

The circuit 80 includes a power source, for example a 2,4-volt battery, housed in a compartment 78 provided below the base member 64. The negative contact of the battery is electrically connected to a capacitor 84 having a capacitance of 10 nF. The capacitor 84 is electrically connected to a integrated circuit 85. The negative pole of the battery is also connected via a capacitor 86 having a capacitance of 2,2 microF and a resistor having a resistance of 2,8 mega ohms, to the integrated circuit 85. The negative pole of the battery is also electrically connected via a capacitor 90 having a capacitance of 2,2 nF, and a resistor 92 having a resistance of 1 mega ohm to the integrated circuit. It is also connected via a capacitor 94 having a capacitance of 10 nF and a resistor having a resistance of 3,3 kilo ohms to the integrated circuit. Finally, it is connected directly via an electrical conductor 95 to the integrated circuit. It is also connected to a light-emitting diode 96 which in turn is connected with each of the switches 75. The switches 75 are also connected to the positive pole or terminal of the battery via an electrical conductor 97 which is also connected directly, via an electrical conductor 98, to the integrated circuit 85. The circuit 85 also includes a Peco electric transducer 99 connected to the integrated circuit and to the electrical conductor 97, and which is provided with a resistor 99.1 having a resistance of 10 kilo ohms.

The circuit 80 and especially the integrated circuit 85 thereof, is adapted so that, on removal of a card from one of the groove 28, the contacts 74,76 of the switches 75 of that groove, come into contact and complete a circuit. On the electrical circuit being completed, the associated light-emitting diode ('LED') 96 will light up, thereby warning a user (not shown) that a card has been removed. The light-emitting diode will then only switch off on the card being replaced inside the holder 62.

In other embodiments of the invention (not shown), the circuit 80, and in particular the integrated circuit 85 may be such that the light-emitting diode 96 will flash intermittently while the card is removed. It may then further be adapted so that the light-emitting diode will only flash intermittently for a predetermined period of time. It may still further be adapted so that this predetermined period of time occurs cyclically at predetermined intervals.

If desired, the circuit may also include at least one aural warning device (not shown), e.g. an alarm, instead of, or in addition to, the LED's 96. If desired, the plurality of LED's 96 may be replaced by a single visual warning device, such as a LED.

The device 60 also includes a channel-shaped cover member, generally indicated by reference numeral 100. The member 100 is adapted to slide over a recessed portion 65 of the sides 68,66 of the holder 62, and has locating formations 102,104 for locating it in position by engaging locating recesses (not shown) in the members 68,66 respectively. In particular, the portions 106,108 of the member 100 may be resiliently flexible with respect to each other to permit it to be passed over the sides 66,68. The outer surfaces of the member 100 may be of aesthetically pleasing appearance, thereby to render the holder 62 aesthetically pleasing. The member 100 can then also easily be replaced by another member 100 having a different appearance. In particular, the holder 62 may be of plastics material. The member 100 can then be of metal, such as gold, silver, copper, platinum, aluminium, etc., or combinations thereof, plastics material or the like. It can also comprise a metal base having a covering of animal hide, such as crocodile hide.

It is to be understood that a member or sleeve, similar to the member 100, can be provided for the devices 10 and 50 hereinbefore described, if desired.

Figure 7:
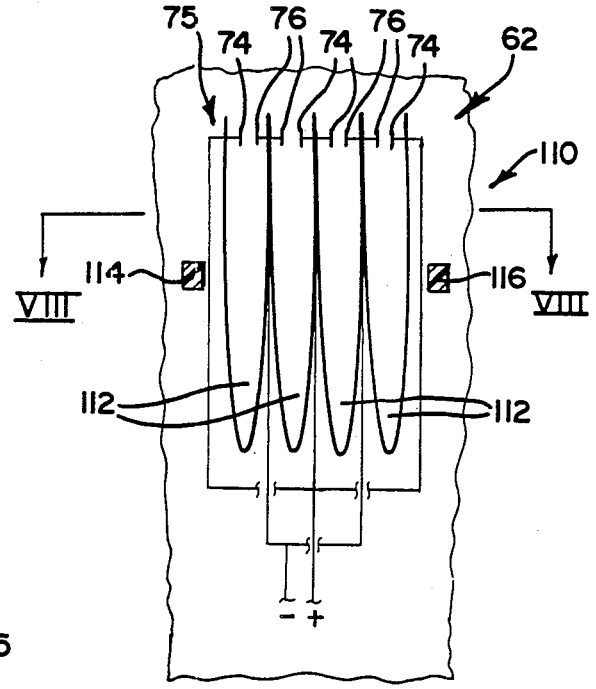
FIG. 7 shows, schematically, a longitudinal sectional view of part of a card holding device according to still another embodiment of the invention.
Figure 8:
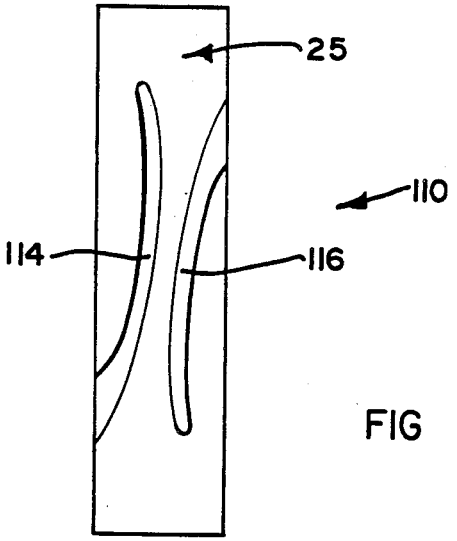
FIG. 8 shows, schematically, a cross-sectional view through VII—VII in FIG. 6, with details omitted for clarity.

Referring to FIGS. 7 and 8, reference numeral 110 generally indicates a card holder according to yet another embodiment of the invention.

Figure 5:
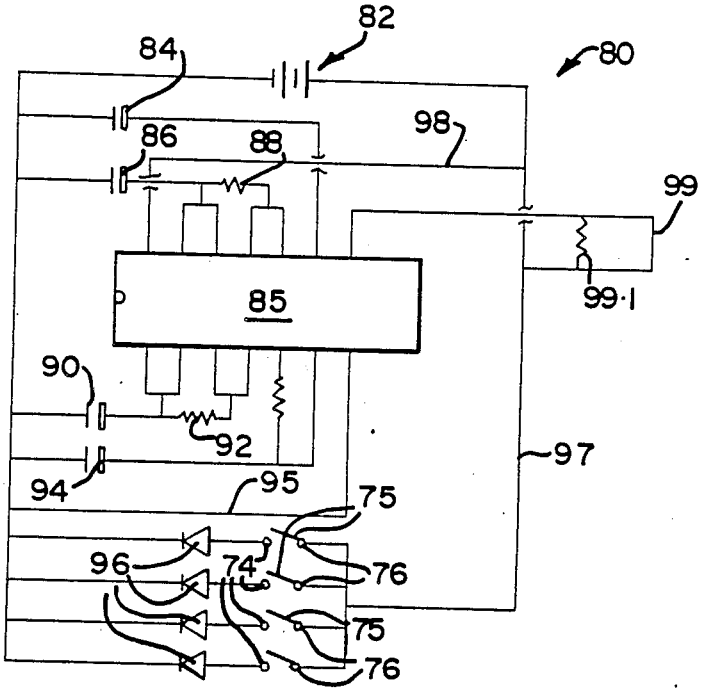
FIG. 5 shows a wiring diagram for the card holding device of FIG. 4.
Figure 6:
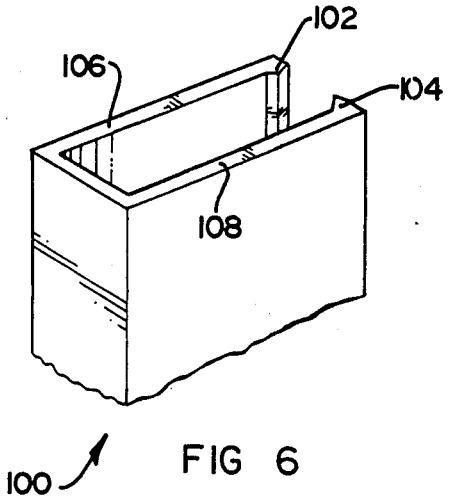
FIG. 6 shows a three-dimensional view of part of an accessory for use with the device of FIG. 4.

Typically, the device 110 may include a holder similar to the holder 60 hereinbefore described with reference to FIGS. 4 to 6. However, instead of having the channels 28,30, the holder 62 includes a plurality of pockets 112 spaced apart from each other and being of flexible non-electrically conductive material, such as felt. Each of the pockets 112 is adapted to hold one card (not shown).

The contacts 74,76 of the switches 75 protrude into the pockets at a high level, and the device 110 includes a pair of bias means 114,116 located below the contacts 74,76 for biassing the pockets towards each other so that the pairs of contacts 74,76 will be in contact with one another when there is no card located in their associated pockets.

The bias members 114,116 each comprise an arcuate-shaped resiliently flexible member which may be formed integrally with the sides of the holder 62. Hence, the members 114,116 may also be of synthetic plastics material.

The Applicant believes that the devices 10, 50, 60 and 110 will be durable and sturdy, and that they will assist a user in not forgetting or misplacing cards. Furthermore, in the case of the holders 60, 110, the warning means will warn the user that a card has been removed or withdrawn. The holders also permit convenient conveyance of the cards, and the cards can be extracted easily and readily from the holders. The windows, when present, also permit visual inspection of the contents of the holders.

If desired, the holders 10, 50 may also be fitted with warning devices similar to those of the device 60.

We claim:

1. A portable pocket-size card-holding device with a holder capable of holding a plurality of cards, comprising a pair of spaced floor and top members, laterally spaced side members extending between the floor and top members, and an end member extending between a first set of ends of the floor, top and side members so that the one end of the holder being closed off and its other end being open, with the members defining between them a cavity;

spaced channels along the top and floor members, the channels being located inside the cavity and extending substantially parallel to one another, the channels of the top member being aligned with those of the bottom members so that, in use, cards in the holder extend substantially parallel to the side members, each pair of channels in the top and floor members providing a card receiving zone capable of accommodating a single card, and all the cards being insertable into and removable from the cavity in the same direction through the open end of the holder, each said channel comprising a base portion and space side portions protruding from the base portion and extending along the base portion, the width of at least one of the channels not exceeding 1.2 mm;

card retention means for retaining the cards in position in the holder, said card retention means comprising a pair of protrusions protruding respectively from one of the side portions towards the other side portion of each channel and spaced with clearance from the other side portion, the pair of protrusions of each channel being aligned with each other; and a key ring attachment fast with the holder.

2. A device according to claim 1, wherein one of the side members is provided with a window so that cards inside the cavity are visible from the outside, the other side member being planar and having indicia applied thereto.

3. A device according to claim 1, which includes a cover hingedly attached to the holder and adapted to close off the open end of the holder, so that, on opening the cover, cards can be inserted into or removed from, the holder.

4. A device according to claim 1, which includes a sleeve located around the top, floor and side members of the holder.

5. A device according to claim 1, wherein locating recesses are provided in at least one of the top members of the holder, the device also including a channel-shaped cover member located partly around the top, bottom and side members of the holder, the cover member having locating formations engaging the location recesses releasably.

6. A portable pocket-size card-holding device, which includes a holder capable of holding a plurality of cards, the holder comprising a plurality of members interconnected to define between them a cavity having a plurality of card-receiving zones each capable of accommodating a single card; and warning means for emitting a warning signal on removal of a card from the holder, the warning means comprising a switch associated with each of the card-receiving zones and adapted to be activated automatically on removal of a card from one of the zones;

an electrically operable warning device;

electric circuitry interconnecting switches and the warning device; and a power source for the circuitry.

7. A device according to claim 6, wherein each of the zones includes a channel along at least one of the members of the holder, the channel including a base portion and spaced side portions protruding from the base portion and extending along the base portion, and each switch comprising a pair of contacts protruding from the side portions of one of the channels, the contacts being biassed towards each other so that they will come into contact with each other when the card is removed from that channel, and will be urged apart by the card when it is inserted into the channel.

8. A device according to claim 6, wherein each zone comprises a pocket of flexible non-electrically conductive material, and each switch comprises a pair of contacts protruding from the side portions of one of the channels, the contacts being biassed towards each other so that they will come into contact with each other when the card is removed from that channel, and will be urged apart by the card when it is inserted into the channel.

9. A portable pocket-size card holding device with a holder capable of holding a plurality of cards, comprising a pair of spaced floor and top members, laterally spaced side members extending between the floor and top members, and an end member extending between a first set of ends of the floor, top and side members so that the one end of the holder being closed off and its other end being open, with the members defining between them a cavity;

spaced channels along the top and floor members, the spaced channels being located inside the cavity and extending substantially parallel to one another, with the channels of the top member being aligned with those of the bottom members so that, in use, cards in the holder extend substantially parallel to the side members, each pair of channels in the top and floor members providing a card receiving zone capable of accommodating a single card, and all the cards being insertable into and removable from the cavity in the same direction through the open end of the holder;

card retention means for retaining the cards in place in the holder;

a key ring attachment fast with the holder;

warning means for emitting a warning signal on removal of a card from the holder, said warning means comprising a switch located in at least one of the spaced channels and adapted to be activated automatically on removal of a card from the zone defined by the channels;

an electrically operable warning device;

electrical circuitry interconnecting the switch and the warning device; and a power source for the circuitry.

10. A device according to claim 9, wherein each channel comprises a base portion and spaced side portions protruding from the base portion and extending along the base portion, the switch comprising a pair of contacts protruding from the side portions of said channel, with the contacts being biassed towards each other so that they will come into contact with each other when the card is removed from that channel, and will be urged apart by the card when it is inserted into the channel.

* * * * *